US005249755A

United States Patent [19]

Jespersen

[11] Patent Number: 5,249,755

[45] Date of Patent: Oct. 5, 1993

[54] BRAKE-TYPE SHEET MATERIAL-DISPENSING ROLL SUPPORT

[75] Inventor: Paul W. Jespersen, Salt Lake City, Utah

[73] Assignee: Georgia-Pacific Corporation, Atlanta, Ga.

[21] Appl. No.: 842,611

[22] Filed: Feb. 27, 1992

[51] Int. Cl.[5] ..... B65H 16/06

[52] U.S. Cl. ..... 242/55.2; 242/55.53

[58] Field of Search ..... 242/55.2, 75.4, 55.53

[56] References Cited

U.S. PATENT DOCUMENTS

| | | | |
|---|---|---|---|
| 2,699,903 | 1/1955 | Montgomery | 242/55.2 |
| 2,707,595 | 5/1955 | Brown | 242/55.2 |
| 2,859,919 | 11/1958 | Debrie | 242/55.11 |
| 3,438,589 | 4/1969 | Jespersen | 242/55.2 |
| 3,572,600 | 3/1971 | Jespersen | 242/55.53 |
| 3,602,450 | 8/1971 | Jespersen | 242/55.53 |
| 3,739,965 | 6/1973 | Jespersen et al. | 225/96 |
| 3,770,221 | 11/1973 | Stern | 242/55.2 |
| 3,850,379 | 11/1974 | Stern | 242/55.2 |
| 4,239,163 | 12/1980 | Christian | 242/55.2 |
| 4,304,367 | 12/1981 | Beere | 242/55.2 |
| 4,447,015 | 5/1984 | Peterson | 242/55.2 |
| 4,522,346 | 6/1985 | Jespersen | 242/55.53 |
| 4,610,407 | 9/1986 | Stubbmann | 242/55.2 |
| 4,660,781 | 4/1987 | Hazard | 242/55.2 |

*Primary Examiner*—Thomas B. Will

*Attorney, Agent, or Firm*—Banner, Birch, McKie and Beckett

[57] ABSTRACT

A device for rotatably supporting a roll of flexible sheet material having trunnions at the ends is provided with structure forming a friction brake to effectively control overspin of the roll during dispensing of the sheet material. The device involves an end support particularly configured to provide a bearing surface formed of resilient, high friction material effective to engage a portion of an end cap forming a roll trunnion, whereby the braking action provided by the bearing surface is directly proportional to the weight of the roll.

21 Claims, 3 Drawing Sheets

BRAKE-TYPE SHEET MATERIAL-DISPENSING ROLL SUPPORT

BACKGROUND OF THE INVENTION

The present invention relates to the dispensing of flexible sheet material, such as toilet tissue, paper toweling, or the like, from rolls. More particularly, the invention relates to apparatus for applying a braking force to the rolls as they rotate in a dispenser in order to prevent the occurrence of undue overspin during the dispensing operation.

Flexible sheet material of the concerned type is characteristically dispensed from a rotatable core about which the material is wound. Dispensing of the material is generally effected by the core being mounted for rotation via trunnions and the core rotated by pulling on the leading end of the web of sheet material that is wound about the core. Dispensers currently in use, such as that described in U.S. Pat. No. 3,739,965 to P. W. Jespersen, et al. and assigned to the assignee herein, commonly employ mechanisms such as time-stops, sheet cut-off devices and/or automatic web feeding mechanisms that add to the energy required to pull the sheet material web from the dispenser. In order to avoid the problem of causing the sheet material, when wet, to simply break off in the user's hands due to the presence of excessive drag on the core, it is desirable to keep such drag to a minimum, as for example, by the use of low-friction journalling means.

A problem arises, however, in instances where the core is journalled in low-friction bearings, that problem being the occurrence of overspin on the body of sheet material when the user imparts excessive pull on the leading end of the web. Overspin, as is well known, is capable of producing a mass of loose material that is released from the wound body and that can reach proportions at which the dispenser can become jammed and thereby rendered inoperative.

The use of braking apparatus in sheet material dispensers of the concerned type is not new, such apparatus being described in U.S. Pat. Nos. 2,699,903, 3,770,221, 4,447,015 and 4,660,781. Braking apparatus which consist essentially of spring-loaded flaps on the roll surface, or spring devices to effect end pressure are not totally dispositive of the problem of concern, however, in that they not only add to the number of mechanisms and components required by the dispenser thereby adding to the space requirement of the dispensers, their cost and their propensity to fail, but they also suffer the disadvantage that, being essentially inertia-dependent, as the weight of the roll decreases so also is the ability of the braking apparatus to control overspin reduced.

Commonly in prior art sheet material dispensing devices of the type in which the inertia and spin of the roll is proportional to the weight of the roll and not its diameter, the braking effect must be compromised by requiring its reduction as the weight of the roll decreases. Thus, in the design of such devices, if the braking characteristics are designed to be accurately effective when the roll acquires a small diameter, then it will concomitantly be of reduced effect when the roll is full, thereby resulting in the undesired overspin. Conversely, if the braking effect is designed to be accurate when the roll is substantially full then, at a near empty condition, the roll will be difficult to rotate thereby resulting in the possible undesired tearing of chips of paper.

It is to the amelioration of these problems therefore, to which the present invention is directed.

SUMMARY OF THE INVENTION

According to a principle aspect of the present invention, therefore, there is provided apparatus for dispensing flexible sheet material wound on a hollow core having a substantially horizontally disposed axis, said apparatus comprising an end cap attached at each end of said core including an axially disposed spindle portion and an annular base having an outwardly facing surface for mounting the adjacent end of said core and an inwardly facing surface concentrically spaced from said spindle; a pair of oppositely spaced end supports, each being adapted to provide vertical support to a respective one of said end caps; and at least one of said end supports having a bearing surface frictionally engaging said inwardly facing surface of said end cap.

The contemplated end support is intended to be formed either entirely or on its frictionally engaging bearing surface of a resilient material, preferably a thermoplastic elastomer.

The end support of the invention is desirably configured to guidingly receive the roll spindle and, in conjunction with a device to impart an axial spring load, thereby retain the roll core in a locked, rotatable condition.

The braking surface according to the invention may be limited in peripheral extent to the upper quadrants of the end support formed on a projecting body portion. Also, the end support structure may be provided with a spindle—receiving opening having a vertically elongated axis in order to compensate for wear that may occur on the periphery of the body portion.

It is therefore an object of the invention to provide apparatus capable of imparting a braking force to a sheet material dispensing roll that varies proportionately to the weight of the paper product on the roll.

It is another object of the invention to provide apparatus of the described type that is readily adaptable for use in existing sheet material dispensers.

Yet another object of the invention is to provide apparatus of the described type that is structurally simple and capable of being constructed and installed at low cost.

These and other objects and advantages of the present invention will become apparent from the following description when considered together with the appended drawings.

DETAILED DESCRIPTION OF A PREFERRED EMBODIMENT

Figure 1:
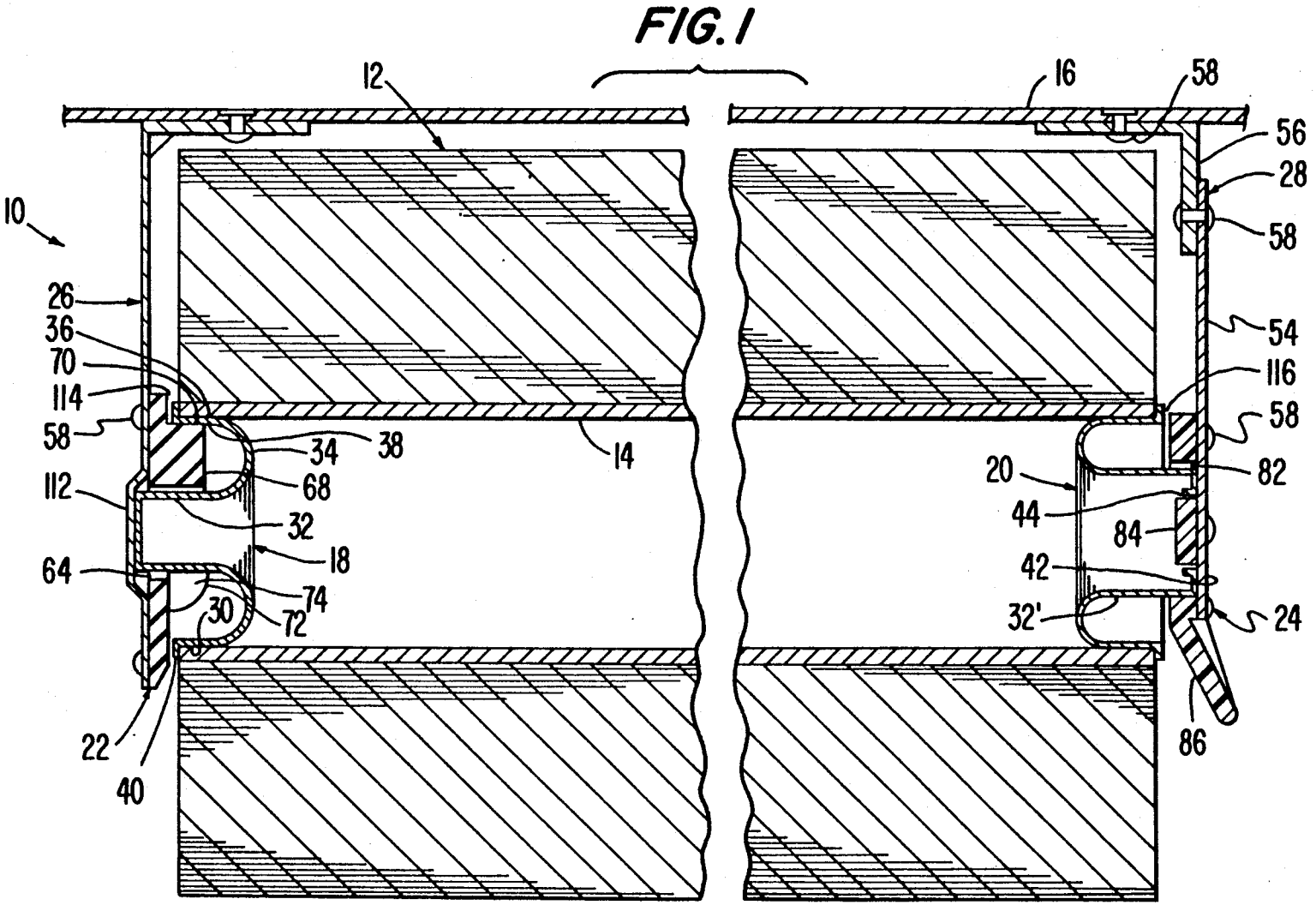
FIG. 1 is a plan sectional view of a towel dispenser arrangement according to the present invention.

The drawing figures illustrate a dispenser organization, represented generally by reference numeral 10, for dispensing flexible sheet material, such as toilet tissue, paper toweling, or the like, according to the present invention. As shown, the flexible sheet material is wound into a roll 12 on an open-ended core 14 that is adapted for rotation within an enclosure, only the rear panel 16 of which is shown in FIG. 1.

The roll 12 is adapted for rotation about a substantially horizontal axis by means of trunnion structure that includes end caps 18 and 20 secured to the roll 12 and that cooperate with end supports 22 and 24 here shown as being attached to the enclosure rear panel 16 by means of brackets 26 and 28. As shown, end cap 18 comprises an outer annular flange portion 30 and an annular spindle portion 32 spaced concentrically inwardly from the flange portion and joined thereto by a web 34 of substantially semi-toroidal configuration. Flange portion 30 has an outwardly-facing bearing surface 36 that is in frictional engagement with the core 14 at one end thereof. The oppositely facing surface 38 of the flange portion 30 forms a bearing surface radially spaced from the spindle portion 32 for purposes hereinafter more fully described. An outturned annulus 40 may be formed on the outer extremity of flange portion 30 to limit the extent of insertion of the end cap 18 within the end of the core 14.

End cap 20, which is inserted within the opposite end of the core 14, has a structural configuration that is generally similar to that of the end cap 18 but, although not particularly germane to the present invention, may, as shown, be provided with a spindle portion 32' of larger diameter than that of the spindle portion 32 of end cap 18. Also, as shown, the end face 42 of the spindle portion 32' may be provided with an opening 44 of a diameter sized to snugly receive the spindle portion 32 of another roll in order to enhance stacking of stored rolls, all as more fully described in U.S. Pat. No. 3,438,589, granted Apr. 15, 1969 to the present inventor.

The end supports 22 and 24 that mount the roll 12 for rotation are fixedly attached to the enclosure rear panel 16 by the brackets 26 and 28 disposed at opposite ends of the roll. In the described arrangement, in order to facilitate replacement of a roll 12 and to enhance retention of the roll between the brackets, one of the brackets, here shown as bracket 28, is preferably formed of a spring metal strip 54 that is flexible in a direction along the axis of the core 14. As shown, the spring metal strip 54 is fixedly secured to the enclosure end panel 16 via angle member 56, one leg of which attaches the strip and the other leg of which is connected to the enclosure panel 16. Connections made to the angle member 56 may, for example, be by way of rivets 58, or the like. Bracket 26, disposed at the other end of the roll 12, is formed of a substantially rigid material throughout its length with the end adjacent the rear panel 16 being displaced angularly inwardly for attachment to the rear panel by rivets 58.

Figure 2:
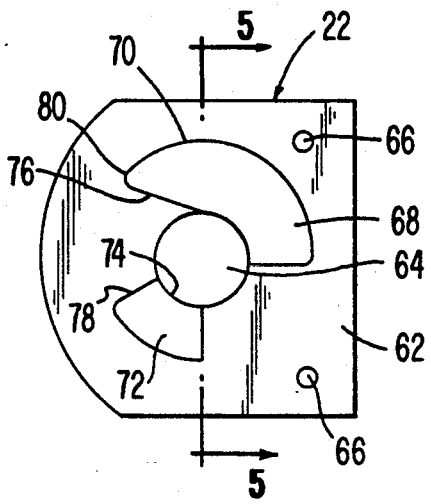
FIG. 2 is a front elevational view of the end cap support of the invention.
Figure 3:
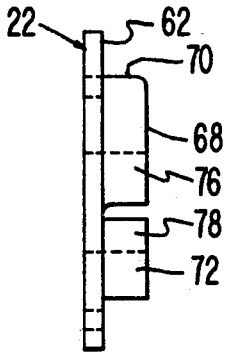
FIG. 3 is a side elevational view of the end cap support of FIG. 2.
Figure 5:
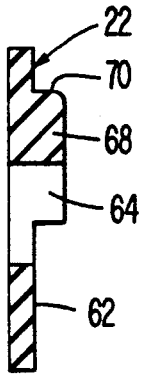
FIG. 5 is a sectional view taken along line 5—5 of FIG. 2.
Figure 4:
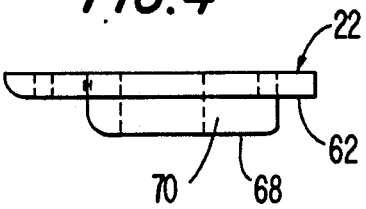
FIG. 4 is a plan view of the end cap support of FIG. 2.
Figure 6:
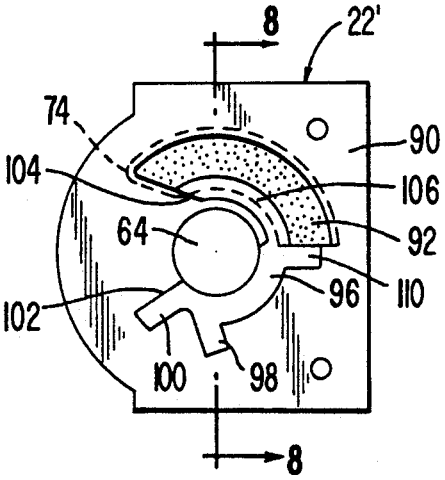
FIG. 6 is a front elevational view of another embodiment of end cap support according to the invention.
Figure 7:
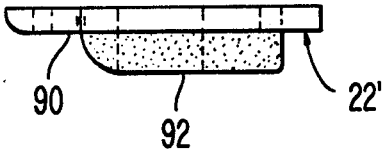
FIG. 7 is a plan view of the end cap support of FIG. 6.
Figure 8:
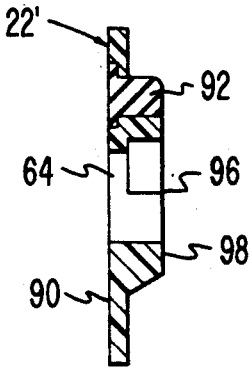
FIG. 8 is a sectional view taken along line 8—8 of FIG. 6.
Figure 9:
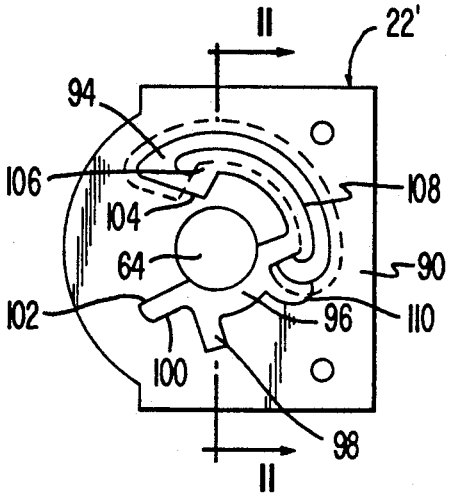
FIG. 9 is a front elevational view of the case structure of the end cap support of FIG. 6.
Figure 10:
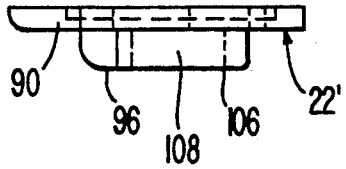
FIG. 10 is a plan view of the case of FIG. 9.
Figure 11:
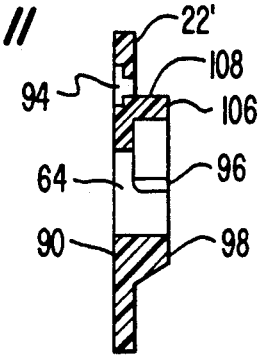
FIG. 11 is a sectional view taken along line 11—11 of FIG. 9.

End support 22 is particularly constructed to apply braking forces to the roll 12 according to the present invention. As shown in FIG. 1 and as detailed in FIGS. 2 to 4, the end support 22 comprises a generally rectangular base 62 having a centrally disposed through-opening 64 for reception of the end cap spindle portion 32. It also possesses a pair of smaller diameter openings 66 for reception of rivets 58 to secure the end support 22 to the bracket 26. From the upper portion of the base 62, a braking element 68 projects and presents an outwardly facing arcuate bearing surface 70 extending about 135 degrees across the upper quadrants of the base in concentrically spaced relation from the opening 64. As shown, the through-opening 64 is preferably formed with an elongated vertical axis in order to effectively compensate for wear of the braking element 68. A smaller, guide projection 72 extends from the lower, forward quadrant of the base with its upper surface 74 being arcuately concave and flush with the opening 64 to enhance the ability of the end support 22 to provide vertical support to the spindle portion 32 of end cap 18. Advantageously, the opposed surfaces 76 and 78 of the braking element 68 and guide projection 72, respectively, are angularly divergent and formed with curvilinear cam-shaped corners 80 to assist positioning of the spindle portion 32 of end cap 18 for reception in the opening 64.

The opposite end of the roll 12 is rotatably supported by the reception of the spindle portion 32' of end cap 20 in the end support 24. To accomplish this, the end support 24, as shown in FIG. 1, may be a member formed entirely as plastic but having the general configuration of the member shown in FIGS. 12 and 13 with a central opening 82 sized for reception of the spindle portion 32' of end cap 20 and having a centering plug 84 for reception in the opening 44 formed in the end face 42 of the spindle portion. An angularly displaced cam plate 86 depends from the lower end of the end support in order to permit the end cap 20 to bias the end support axially outwardly under the influence of the spring metal strip 54 whereby the spindle portions 32 and 32' of end caps 18 and 20 can be received in the respective end supports 22 and 24 and thereafter resiliently retained therein for rotation.

Figure 12:
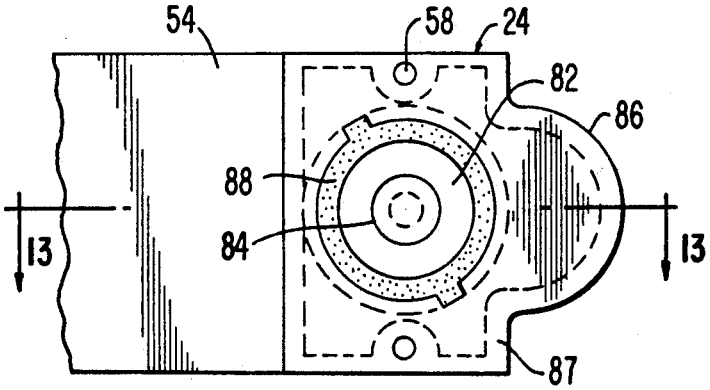
FIG. 12 is a front view of an opposing roll support for use with the support of the invention.
Figure 13:
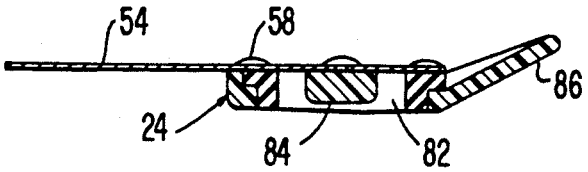
FIG. 13 is a sectional view taken along line 13—13 of FIG. 12.

As shown in FIG. 1, the end support 24 and its centering plug 84 are secured to the strip 54 by means of connectors, such as rivets 58, or the like. As an alternative construction, the end support 24 may be formed, as shown in FIGS. 12 and 13, as a plastic body 87 wherein the opening 82 is provided with a liner 88 formed of resilient material, such as a thermoplastic elastomer. As a further alternative construction, not shown in the drawing figures, the centering plug 84 can be eliminated, as for example, would be required with end caps having spindle portions 32' devoid of an opening 44 in the end face 42.

As shown best in FIG. 1, the braking element 68 in the end support 22 is sized to be received in the space between the exterior surface of the spindle portion 32 and the interior surface of the flange portion 30 of end cap 18, whereby the outwardly facing arcuate bearing surface 70 of the braking element is, due to gravity, caused to engage the inwardly facing surface 38 of the flange portion. Therefore, because the frictional engagement of the end cap 18 and the end support 60 occurs at the interface between the surface 70 of the braking element 68 and the surface 38 on the end cap flange portion 30 and because this engagement occurs at a considerably greater radial distance from the rotational axis of the roll 12 than the external surface of the end cap spindle portion 32, the braking effect produced by the frictional engagement between the end cap surface 38 and the surface 70 on the braking element 68 is considerably magnified.

However, in order to compound the braking effect produced by the braking element 68, it is contemplated that it be formed of a resilient material, such as a thermoplastic elastomer. Accordingly, as illustrated in FIGS. 1 to 5, the end support 22 can be formed entirely of the indicated resilient material or, alternatively, as shown in FIGS. 6 to 11, the end support, indicated as 22', can be formed as a plastic body 90 with only the braking element being resiliently formed as an elastomeric plug 92 mounted in a shouldered, accurately curved opening 94.

Preferably, in order to strengthen the plastic body 90 forming the base in the end support 22' and to increase the bearing surface available to accommodate the spindle 32 of end cap 18, there is provided a shouldered projection 96 that extends continuously about the lower portion of the opening 64 in the body and the lower edge of the opening 94. As shown best in FIGS. 6 and 9, the projection 96 possesses radiating elements at longitudinally spaced locations along its length. Element 98 serves to structurally stiffen the body 90 beneath the opening 64 while element 100, in addition to strengthening the body 90, provides a divergent surface 102 which, in cooperation with the oblique end surface 104 of portion 106 of the projection 96, serves the same positioning function as is provided by the corresponding divergent surfaces 76 and 78 in the previously described embodiment of the invention. The upwardly facing surface 108 of portion 106 provides underlying support for the resilient braking plug 90, while element 110 serves to buttress longitudinal loading of the plug generated by the rotating roll 12 thereon.

In operation, the roll 12 is loaded into the dispenser by simple manipulation of the end support 24 by the end cap 20, wherein the spindle portion 32' engages the cam plate 86 to flex the end support axially outwardly. Simultaneously therewith, the spindle portion 32 of end cap 18 is installed in the central opening 64 in end support 22 with such installation being facilitated by the guiding effect provided by the opposed divergent surfaces 76 and 78 of the first embodiment of the invention and surfaces 102 and 104 in the latter embodiment thereof.

In order to lockingly retain the roll 12 in the dispenser, the bracket 26 is provided with a depressed receptacle 112 axially aligned with the opening 64 to receive the leading end of the spindle portion 32 when the roll is biased along the axis of core 14 by the return of the end support to the unflexed position of the bracket 28. It will be appreciated, in order to prevent disruption of roll rotation in the dispenser, that the spindle portions 32 and 32' of the respective end caps 18 and 20, the depth of the receptacle 112, and the location of the brackets 26 and 28 must be such as to create adequate clearance spaces, indicated as 114 and 116, between the opposite ends of the roll core 14 and the adjacent end supports 22 and 24.

When the roll 12 is properly installed in the dispenser, vertical support therefore is provided at one end by the bearing engagement between the inwardly facing surface 38 of end cap 18 with the outwardly facing friction surface 70 of the braking projection 68 on end support 22 and at the other end by reception of spindle 32' in the recess 82 formed in end support 24. Thereafter, the user grasps the free end of the sheet material on the roll 12 causing the material to be dispensed as the roll rotates in the journals formed by the cooperation between the spindle portions 32 and 32' of end caps 18 and 20 with the respective end supports 22 and 24. Upon release of the pulling force, the braking effect generated by the large amount of surface area presented by the inwardly facing surface 38 of portion 30 of end cap 18 in frictional engagement with the outwardly facing peripheral surface 70 of the braking projection 68 on end support 22 causes the roll 12 to be effectively braked. Moreover, due to the relationship between the portion 30 of the end cap 18 and the braking projection 68 on the end support 22, the braking forces imparted to the roll can be optimally controlled so that sufficient braking action is generated to prevent undue overspin of the roll 12, which action is reduced substantially proportionately as the weight of the roll decreases upon dispensing of sheet material therefrom.

By this simple, inexpensive device, therefore, journalling of sheet material rolls can be effected in a manner as to eliminate the imposition of excessive braking forces on a full roll that would otherwise increase the energy required by the user to operate the dispenser while, concomitantly, increasing the danger of pulling off chips of paper, as when the material is wet. Moreover, this device effects a proportionate reduction in the braking effect required to terminate roll rotation as material is dispensed therefrom so that overspin of a less weighted roll can be readily prevented.

While the present invention has been described with reference to specific preferred embodiments thereof, it will be obvious to those skilled in the art that various changes and modifications can be made without departing from the scope of the claims appended hereto.

I claim:

1. Apparatus for dispensing flexible sheet material wound on a hollow core having a substantially horizontally disposed axis, said apparatus comprising:

an end cap attached at each end of said core including an axially disposed spindle portion and an annular base connected to said spindle portion by a radially extending web, said annular base having an outwardly facing surface for mounting the adjacent end of said core and an inwardly facing surface concentrically spaced from said spindle;

a pair of oppositely spaced end supports, each engaging a respective one of said end caps to provide vertical support thereto; and at least one of said end supports having a body only the upwardly facing portion of which defines a bearing surface in gravity-induced frictional engagement with the adjacent portion of said inwardly facing surface of said end cap.

2. Apparatus according to claim 1 in which the portion of said end support containing said bearing surface is formed of a resilient material.

3. Apparatus according to claim 2 in which said resilient material is a thermoplastic elastomer.

4. Apparatus according to claim 2 in which said end support is formed entirely of said resilient material.

5. Apparatus according to claim 2 in which said end support comprises a body of relatively rigid material; and means on said body for mounting said bearing surface.

6. Apparatus according to any one of claims 1 to 5 in which said apparatus includes an end support journalling one of said end caps at said spindle.

7. Apparatus according to claim 6 in which said spindle-journalling end support comprises a body containing a generally cylindrical recess therein adapted to rotatably receive said end cap spindle.

8. Apparatus according to claim 7 including means for axially biasing said end supports into mounting engagement with said end caps.

9. Apparatus according to claim 8 in which said biasing means comprises a bracket formed spring metal mounting one of said end supports.

10. Apparatus according to claim 9 in which said bracket formed of spring metal mounts said spindle-journalling end support; and a bracket formed of rigid material mounting said end support having said bearing surface.

11. Apparatus for dispensing sheet material wound on a hollow core having a substantially horizontally disposed axis and journalled for rotation at each end by an end cap including an axially disposed spindle and an annular base having an outwardly facing surface engaging said core and an inwardly facing surface concentrically spaced from said spindle, said apparatus including an end support comprising:

a fixed body having an opening extending parallel to the axis of said core for reception of said spindle; and a substantially arcuate bearing surface on said body concentrically spaced from said opening and extending through the upper quadrants of said body for gravity-induced frictional engagement with said inwardly facing surface of said end cap.

12. Apparatus according to claim 11 in which said bearing surface extends arcuately through a range of from about 90° to about 150° across the upper quadrants of said body.

13. Apparatus according to claim 12 in which said bearing surface arcuately extends about 135° across the upper quadrants of said body.

14. Apparatus according to any one of claims 11 to 13 in which said body includes a portion projecting therefrom in a core-receiving direction, said portion having an arcuately formed, outwardly facing peripheral surface defining said bearing surface.

15. Apparatus according to claim 14 in which said portion is formed of a resilient material.

16. Apparatus according to claim 15 in which said resilient material is a thermoplastic elastomer.

17. Apparatus according to claim 16 in which said portion is integrally formed on a body made of said thermoplastic elastic.

18. Apparatus according to claim 16 in which said body is formed of a substantially rigid material and includes means thereon for attaching an element of thermoplastic elastomer forming said portion.

19. Apparatus according to claim 15 in which said opening is elongated along its vertical axis.

20. Apparatus according to claim 19 including a guide projection adjacent a lower portion of said opening, said guide projection projecting outwardly from said body beneath said body portion; said body portion and said guide projection containing divergent, mutually facing surfaces operative to guide said spindle into said opening.

21. Apparatus according to claim 20 in which said guide projection and said body portion are formed with curvilinearly shaped cam surfaces for guiding said spindle into said opening.

* * * * *